US006276113B1

(12) United States Patent
Bernhard

(10) Patent No.: US 6,276,113 B1
(45) Date of Patent: Aug. 21, 2001

(54) SETUP TABLE FOR BOTTLE HANDLING MACHINES

(75) Inventor: Herbert Bernhard, Wolfsheim (DE)

(73) Assignee: KHS Maschinen-und Anlagenbau AG, Dortmund (DE)

( * ) Notice: Subject to any disclaimer, the term of this patent is extended or adjusted under 35 U.S.C. 154(b) by 0 days.

(21) Appl. No.: 09/282,975

(22) Filed: Mar. 31, 1999

(30) Foreign Application Priority Data

Apr. 1, 1998 (DE) ..... 198 14 625

(51) Int. Cl.[7] ..... B65B 1/04

(52) U.S. Cl. ..... 53/253; 53/331.5; 53/317; 53/319

(58) Field of Search ..... 53/137.1, 202, 53/282, 317, 319, 331.5, 253; 414/568

(56) References Cited

U.S. PATENT DOCUMENTS 3,771,284 * 11/1973 Boeckmann et al. ..... 53/282
5,020,297 * 6/1991 Borie et al. ..... 53/127
5,301,488 * 4/1994 Ruhl et al. ..... 53/55
5,419,094 * 5/1995 Vander Bush, Jr. et al. ..... 53/75
5,893,259 * 4/1999 Posge ..... 53/488
6,115,992 * 9/2000 Bankuty et al. ..... 53/308

* cited by examiner

*Primary Examiner*—Peter Vo
*Assistant Examiner*—John Paradiso
(74) *Attorney, Agent, or Firm*—Nils H. Liungman & Associates

(57) ABSTRACT

A setup table on a bottle handling machine which includes feed-end and delivery-end star wheels and associated guide tracks for the bottles as well as drive devices for the individual star wheels and handling stations, and a support plate that covers the drive devices. A plurality of handling machines are combined into a unit, and the axis of rotation of a rinser is located on a first line, and the axes of rotation of the feed-end and delivery-end star wheels of the rinser and of the filling machine are located on a second line that runs at some distance from the first. The axis of the delivery-end star wheel of the filling machine and the axis of rotation of a crown corker are located on an additional line that runs at an angle to the second line. The axis of an additional capping machine and the axis of the delivery-end star wheel of the crown corker and of the additional capping machine are located on an additional line that runs parallel to this third line.

14 Claims, 2 Drawing Sheets

SETUP TABLE FOR BOTTLE HANDLING MACHINES

BACKGROUND OF THE INVENTION

1. Field of the Invention

The present invention relates to a setup table for bottle handling machines with feed-end and delivery-end star wheels and associated guide tracks for the bottles, as well as drive devices for individual star wheels and handling stations, and a support plate that covers the drive devices.

2. Background Information

Setup tables of the type described above are found on bottle handling machines upstream of the actual large handling rotary bodies which can have a number of circular handling spaces located next to one another for the individual bottles. To feed and remove the bottles, such a setup table can have a feed-end worm gear which is used to establish the spacing of the bottles as a function of the distance between the handling spaces on the rotary bodies. The feed-end worm gear can then transfer the bottles with the appropriate distance between them into circulating intermediate star wheels, which then in turn can deliver the bottles to the handling spaces. After the bottles have been cycled through to the outlet-side area of the rotating bodies, corresponding transfer start wheels can be provided to remove and transport the bottles further.

Additional handling stations, e.g. capping machines, labeling machines etc. can be located in this setup table area. As a result of the high speed of circulation, fragments of glass and residual fluids are often found in this overall area, which means that periodic cleanings are correspondingly necessary.

In particular when such machines are combined into large units or assemblies, with the conventional layout and sequencing of these machines, there are a plurality of transfer points and feed-end and delivery-end start wheels, which on one hand represent bottlenecks on high capacity machines, and on the other hand form problem zones, in particular from the hygienic point of view, as a result of the accumulation of glass fragments and residual fluids.

OBJECT OF THE INVENTION

The object of the present invention is therefore to realize a setup table, in particular when a plurality of machines are combined into a unit, with substantially optimal bottle guidance and the substantial elimination of additional intermediate star wheels.

SUMMARY OF THE INVENTION

The present invention teaches that this object can be accomplished by a setup table of the type described above in which a plurality of handling machines are joined together to form a unit, and, the axis of rotation of a rinser is located on a first line, and the axes of rotation of the feed-end and delivery-end star wheel and of the filling machine can be located on a second line running at some distance from the first line, and the axis of the outlet star of the filling machine and the axis of a crown corker are located on an additional line that can run at an angle to the second line, and the axis of an additional capping machine and the axis of the deliver-end star wheel of the crown corner and of the additional capping machine can be located on an additional line that runs parallel to this third line.

The present invention also teaches that the delivery-end star wheel of the filling machine can be realized in the form of the feed-end star wheel of the crown corker and of an additional capping machine.

Additional features are described hereinbelow and in the subclaims.

As a result of this configuration, a particularly advantageous hygienic configuration is achieved which is substantially free of any dirt-catching corners etc., and can be cleaned easily. The fragments of glass can be collected and removed immediately upstream of the rotary bodies that handle the machines. At the same time, there is a substantially optimal guidance of the containers being handled.

The above discussed embodiments of the present invention will be described further hereinbelow with reference to the accompanying figures. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

At least one preferred embodiment of the present invention is illustrated in FIGS. 1 and 2, wherein.

DESCRIPTION OF THE PREFERRED EMBODIMENT

Figure 1:
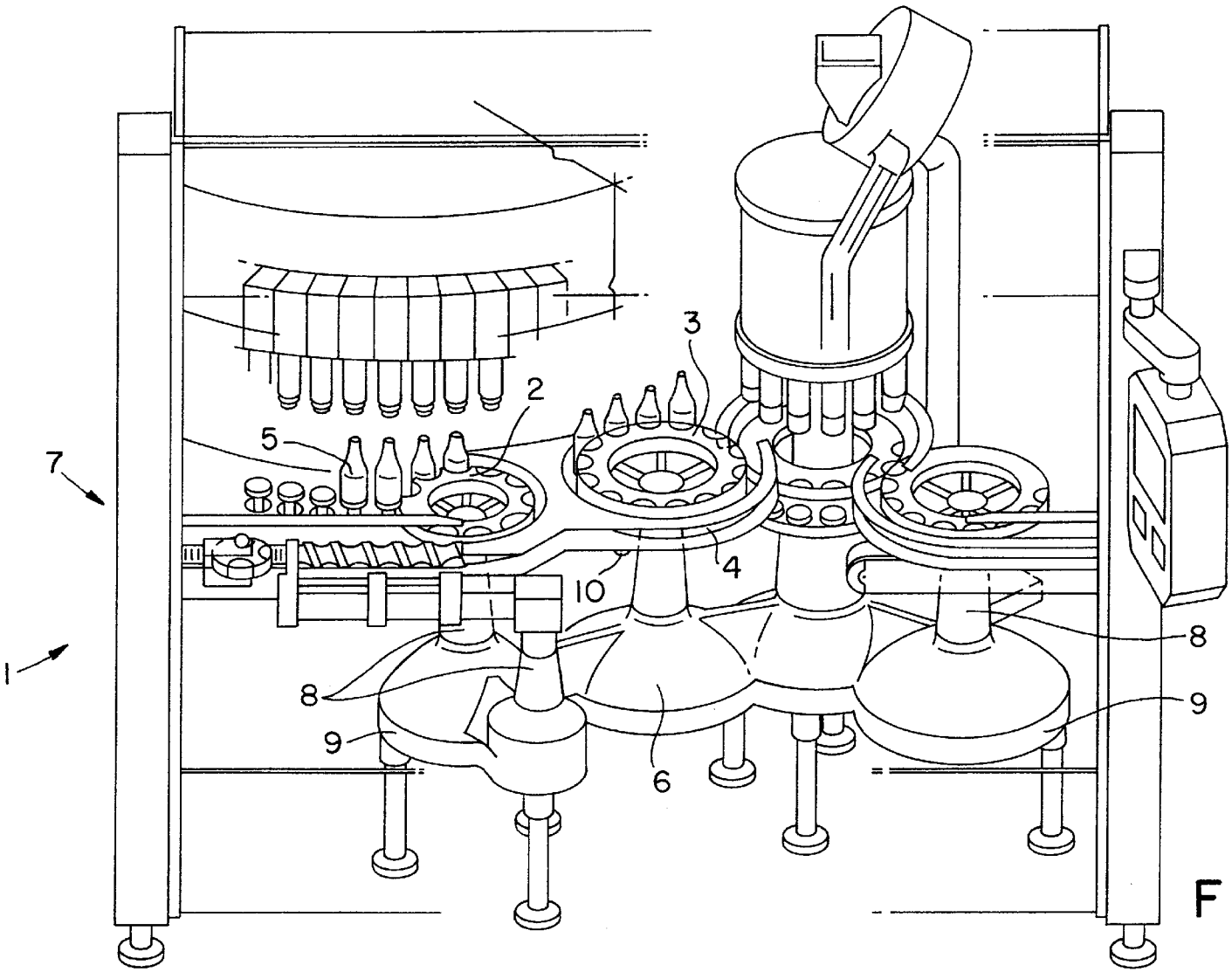
FIG. 1 shows the front side of a setup table.
Figure 2:
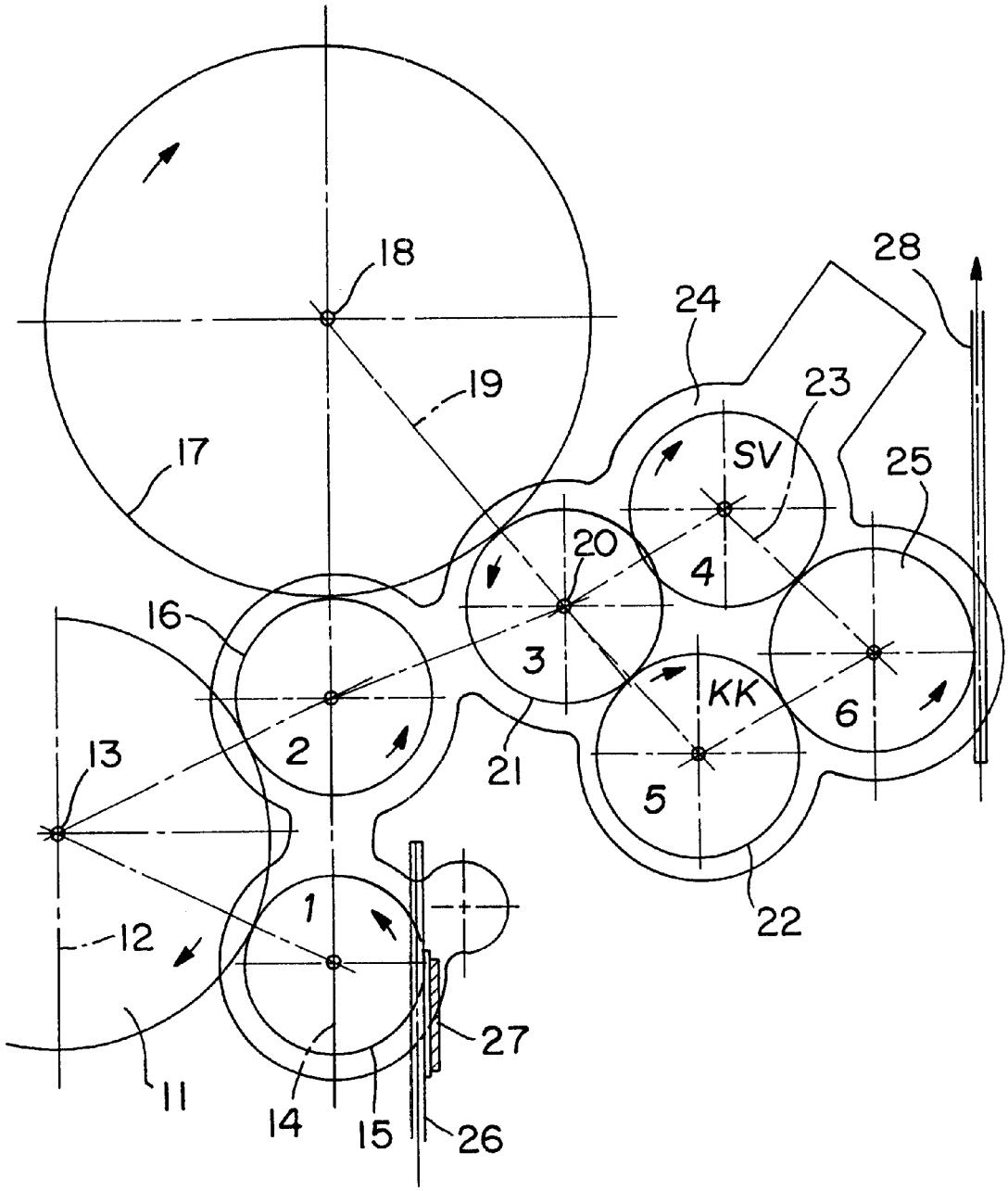
FIG. 2 shows an overhead view of a setup table for a plurality of machines.

As shown in FIGS. 1 and 2, a setup table 1 can include feed-end and delivery-end star wheels 2, 3 and associated guide tracks 4 for bottles 5. There are also drive devices (not shown) for the individual star wheels 2, 3 and handling stations. The drive devices can be substantially covered by a support plate or cover 6. The setup table 1, in the vicinity of the bottle transport plane 7, includes substantially only the required bottle transport and bottle guidance devices. The drive devices themselves are covered and can be located at some significant distance below this level. For this purpose, the support plate 6 can be realized in the form of a hood, and is equipped with additional columns 8 and/or with tower-like housings that extend upward, through which the respective drive shafts for the feed-end and delivery-end stars 2, 3 etc. which can extend upward. The support plate 6 itself can be appropriately designed so that its outer contour substantially tracks the contours of the corresponding drive devices. These drive devices comprise, for example, meshing gear wheels etc. The columns 8 that extend upward can be connected with the support plate 6 in a sealed manner. The columns 8 can be appropriately slightly tapered at the top. The columns 8 can also be realized in the form of truncated cones or truncated pyramids. As illustrated, the support plate 6 has a rather small segment 9 that extends vertically and starting at this area, it ascends diagonally and/or in a curved manner to the bottom edge of the respective column 8. The support plate 6 can be realized, for example, in the form of a casting or as a welded structure. In the upper area, the columns 8 can have support arms 10 that extend outward in a star shape for the respective transport and bottle guidance devices.

In the exemplary embodiment illustrated in FIG. 2, the setup table is realized for use with a combination of a plurality of machines into a single unit. In this case, the rinser 11 with its axis of rotation 13 is located on a first line 12. On a second line 14, which second line preferably runs parallel or even at an angle to the first line 12, are the axes of rotation of the feed-end star wheel 15, of the delivery-end star wheel 16, which is simultaneously the feed-end star wheel of the filling machine 17, and its axis 18.

In other possible embodiments of the present invention, it may be possible for the axis of rotation 13 of the rinser 11 to be located on a line not parallel to the second line 14. In at least one embodiment of the present invention, the axis 13 of the rinser 11 can be on a line perpendicular to the second line 14, or substantially perpendicular to the second line 14.

The axis 20 of the delivery-end star wheel 21 of the filling machine 17 and the axis of a crown corker 22 are on an additional line 19 that runs at an angle to the second line 14. The axes of an additional capping machine, for example a screw-top capping machine 24, and of the delivery-end star wheel 25, are on a fourth line 23.

The delivery-end star wheel 21 of the filling machine 17 can be simultaneously the feed-end star wheel of the crown corker 22 and of the screw-top closing machine 24.

The delivery-end star wheel 25 is likewise provided for both capping machines 22, 24.

The axes of the filler delivery-end star wheel 21, of the crown corker 22, of the capping machine 24 and of the delivery-end star wheel 25 can appropriately form the corners of a square, a rectangle or of a parallelogram, for example.

In at least one embodiment of the present invention, the third line 19, for example, can run at an angle of approximately 45 degrees, but that angle is not required in other possible embodiments of the present invention.

Other angles for the third line, with respect to the second line, can also be used within the scope of the present invention.

The bottles to be handled can be delivered by conveyor belts 26 of a spacing worm gear 27, placed at the required spacing for the feed-end star wheel 15, and delivered by the feed-end star wheel 15 to the rinser 11. After the treatment, the bottles can leave the rinser via the delivery-end star wheel 16 and are transported toward the filling machine 17, and from there, via its delivery-end star wheel 21, they are transported either into the crown corker 22 or into the screw-top closing machine 24, after which they leave the unit via the delivery-end star wheel 25 and the delivery-end conveyor 28. In this manner, the distances from and to the individual machines are kept optimally short, which consequently optimizes the path of the bottles through the cycle.

One feature of the invention resides broadly in the setup table on bottle handling machines with feed-end and delivery-end star wheels and associated guide tracks for the bottles as well as drive devices for the individual star wheels and handling stations, and a support plate that covers the drive devices, characterized by the fact that a plurality of handling machines are combined into a unit, and the axis of rotation 13 of a rinser 11 is located on a first line 12, the axes of rotation of the feed-end and delivery-end star wheels 15, 16 of the rinser 11 and of the filling machine 17, 18 are located on a second line 14 that runs at some distance from the first, and the axes 20 of the delivery-end star wheel 21 of the filling machine 17 and the axis of rotation of a crown corker 22 are located on an additional line 19 that runs at an angle to the second line 14, and the axes of an additional capping machine 23 and the axis of the delivery-end star wheel 25 of the crown corker 22 and of the additional capping machine 24 are located on an additional line 23 that runs parallel to this third line 19.

Another feature of the invention resides broadly in the setup table characterized by the fact that the delivery-end star wheel 21 of the filling machine 17 is realized as the feed-end star wheel of the crown corker 22 and of an additional capping machine 24.

Yet another feature of the invention resides broadly in the setup table characterized by the fact that the delivery-end star wheel 25 of the crown corker 22 is also realized as the delivery-end star wheel of the additional capping machine 24.

Still another feature of the invention resides broadly in the setup table characterized by the fact that the axes of the filler delivery-end star wheel 21, of the crown corker 22, of the additional capping machine 24 and of the final delivery-end star 25 form the corners of a square, of a rectangle or of a parallelogram.

A further feature of the invention resides broadly in the setup table characterized by the fact that the third line 10 runs at an angle of 45 degrees to the second line 14.

Another feature of the invention resides broadly in the setup table characterized by the fact that in the area of the bottle transport plane 7, the table consists only of the necessary bottle transport and bottle guidance devices 2–4, and the drive devices are located underneath and at a significant distance from the bottle transport plane 7 and are covered in the manner of a hood, and their drive shafts are enclosed by column-like and/or tower-like housings 8 that extend to the bottle transport plane 7.

Yet another feature of the invention resides broadly in the setup table characterized by the fact that the individual stars and transport devices 2–4 are operated by shafts driven on the bottom end, and these shafts are enclosed by columns 8 that begin above the support plate 6.

Still another feature of the invention resides broadly in the setup table characterized by the fact that the support plate 6 with its edge, essentially tracks the contour of the drive devices that correspond to one another.

A further feature of the invention resides broadly in the setup table characterized by the fact that the columns 8 are connected with the support plate 6 in a sealed manner.

Another feature of the invention resides broadly in the setup table characterized by the fact that the columns 8 are tapered conically, at least in their area pointing toward the bottom of the support plate 6.

Yet another feature of the invention resides broadly in the setup table characterized by the fact that the columns 8 are realized in the form of truncated cones and/or truncated pyramids.

Still another feature of the invention resides broadly in the setup table characterized by the fact that the support plate 6 is realized so that it ascends diagonally or in a curved manner from its lower portion 9, and supports the columns 8 of the individual drive shafts.

A further feature of the invention resides broadly in the setup table characterized by the fact that the support plate 6 is realized in the form of a single-level casting or welded body, and the columns 8 of the individual drives are connected with it.

Another feature of the invention resides broadly in the setup table characterized by the fact that in the upper portion of the columns 8, there are support arms 10 that extend outward in the shape of a star for the transport and bottle guidance devices 2–4.

Possible examples of the interconnection between the components of the bottling system and of the design of the setup table 1, the star wheels 2,3 the guide tracks 4, the support plate 6 the columns 8 and the vertical segments 9, may be found in U.S. patent application Ser. No. 09/151,845, filed on Sep. 11, 1998, which has the inventors Ulrich Petri and Klaus-Werner Jung, and which is assigned to KHS Maschinen-und Anlagenbau Aktiengesellschaft, which U.S. Patent Application is hereby incorporated by reference as if set forth in its entirety herein.

Examples of bottling systems, which may be used in or with embodiments of the present invention, may be found in the following U.S. Patents, which are hereby incorporated by reference, as if set forth in their entirety herein: U.S. Pat. No. 5,634,500, issued on Jun. 3, 1997 and entitled "Method for Bottling a Liquid in Bottles or Similar Containers"; U.S. Pat. No. 5,558,138, issued Sep. 24, 1996 and entitled "Process and Apparatus for Cleaning Container Handling Machines Such as Beverage Can Filling Machines"; and U.S. Pat. No. 5,713,403, issued Feb. 3, 1998 and entitled "Method and System for Filling Containers with a Liquid Filling Product, and Filling Machine and Labelling Device for Use with this Method or System". All of the above U.S. patent documents in this paragraph are assigned to KHS Maschinen- und Anlagenbau Aktiengesellschaft of the Federal Republic of Germany.

Examples of container labelling and/or filling machines and components thereof and/or accesories therefor which may be used in embodiments of the present invention, may be found in the following documents, which are hereby incorporated by reference, as if set forth in their entirety herein: U.S. Pat. No. 4,944,830 issued on Jul. 31, 1990 and entitled "Machine for Labelling Bottles"; U.S. Pat. No. 4,911,285 issued on Mar. 27, 1990 and entitled "Drive for a Rotary Plate in a Labelling Machine for Bottles"; U.S. Pat. No. 4,976,803 issued on Dec. 11, 1990 and entitled "Apparatus for Pressing Foil on Containers, Such As on the Tops & the Necks of Bottles or the Like; U.S. Pat. No. 4,950,350 issued on Aug. 21, 1990 and entitled "Machine for Labelling Bottles or the Like"; U.S. Pat. No. 5,017,261 issued on May 21, 1991 and entitled "Labelling Machine for Objects Such as Bottles or the Like"; U.S. Pat. No. 5,062,917 issued on Nov. 5, 1991 and entitled "Support Element for the Followers of a Cam Drive of a Drive Mechanism & a Labelling Station Equipped With a Support Element"; U.S. Pat. No. 4,981,547 issued on Jan. 1, 1991 and entitled "Mounting & Drive Coupling for the Extracting Element Support of a Labelling Station for a Labelling Machine for Containers and Similar Objects"; U.S. Pat. No. 5,004,518 issued on Apr. 2, 1991 and entitled "Labelling Machine for Objects such as Bottles or the Like"; U.S. Pat. No. 5,078,826 issued on Jan. 7, 1992 and entitled "Labelling Machine for the Labelling of Containers"; U.S. Pat. No. 5,062,918 issued on Nov. 5, 1991 and entitled "Glue Segments which can be Attachable to a Drive Shaft of a Labelling Machine"; U.S. Pat. No. 5,227,005 and issued on Jul. 13, 1993 and entitled "Labelling Station for Labelling Objects, Such as Bottles"; U.S. Pat. No. 5,087,317 issued on Feb. 11, 1992 and entitled "Labelling Machines for the Labelling of Container"; U.S. Pat. No. 5,129,984 issued on Jul. 14, 1992 and entitled "Bottle Labelling Machine"; U.S. Pat. No. 5,185,053 issued on Feb. 9, 1993 and entitled "Brushing Station for a Labelling Machine for Labelling Bottles & the Like"; U.S. Pat. No. 5,075,123 issued on Dec. 24, 1991 and entitled "Process & Apparatus for Removing Alcohol From Beverages"; U.S. Pat. No. 5,217,538 issued on Jun. 8, 1993 and entitled "Apparatus & Related Method for the Removal of Labels & Foil Tags Adhering to Containers, in Particular, to Bottles"; U.S. Pat. No. 5,174,851 issued on Dec. 29, 1992 and entitled "Labelling Machine for Labelling Containers, Such as Bottles"; U.S. Pat. No. 5,110,402 issued on May 5, 1992 and entitled "Labelling Machine for Labelling Containers Such as Bottles Having a Labelling Box for a Stack of Labels in a Labelling Station"; U.S. Pat. No. 5,167,755 issued on Dec. 1, 1992 and entitled "Adhesive Scraper Which Can be Adjusted in Relation to an Adhesive Roller in a Labelling Machine"; U.S. Pat. No. 5,413,153 issued on May 9, 1995 and entitled "A Container Filling Machine for Filling Open-Top Containers, & A Filler Valve Therefor"; U.S. Pat. No. 5,569,353, issued on Oct. 29, 1996 and entitled "Labelling Machine & Apparatus for the Automatic Loading of the Main Magazine of a Labelling Machine, & A Supply Magazine Which Can Be Used in Such an Apparatus". All of the above U.S. patent documents in this paragraph are assigned to KHS Maschinen- und Anlagenbau Aktiengesellschaft of the Federal Republic of Germany.

Some additional examples of container filling systems, valves or methods and their components which may be incorporated in an embodiment of the present invention may be found in U.S. Pat. No. 5,425,402, issued on Jun. 20, 1995 and entitled "Bottling System with Mass Filling and Capping Arrays"; U.S. Pat. No. 5,450,882, issued on Sep. 19, 1995 and entitled "Beverage Dispensing Apparatus and Process"; U.S. Pat. No. 5,377,726, issued on Jan. 3, 1995 and entitled "Arrangement for Filling Bottles or Similar Containers"; U.S. Pat. No. 5,402,833, issued on Apr. 4, 1995 and entitled "Apparatus for Filling Bottles or Similar Containers"; and U.S. Pat. No. 5,445,194, issued on Aug. 29, 1995 and entitled "Filling Element for Filling Machines for Dispensing a Liquid Filling Material into Containers."

Some additional examples of methods and apparatuses for closing bottles and containers and their components which may be incorporated in an embodiment of the present invention may be found in U.S. Pat. No. 5,402,623, issued on Apr. 4, 1995, and entitled "Method and Apparatus for Closing Bottles"; U.S. Pat. No. 5,473,855, issued on Dec. 12, 1995 and entitled "System for Installing Closures on Containers"; U.S. Pat. No. 5,447,246, issued on Sep. 5, 1995 and entitled "Methods and Combinations for Sealing Corked Bottles"; U.S. Pat. No. 5,425,402, issued on Jun. 20, 1995 and entitled "Bottling System with Mass Filling and Capping Arrays"; U.S. Pat. No. 5,398,485, issued on Mar. 21, 1995, and entitled "Bottle Support Mechanism for a Capping Machine"; U.S. Pat. No. 5,419,094, issued on May 30, 1995 and entitled "Constant Speed Spindles for Rotary Capping Machine"; and U.S. Pat. No. 5,449,080, issued on Sep. 12, 1995 and entitled "Methods and Combinations for Sealing Corked Bottles."

Examples of rotary position sensors and rotary position indicators, components thereof, and components associated therewith, which may be utilized in accordance with the embodiments of the present invention, may be found in the following U.S. Pat. No. 4,458,893, which issued to Ruh on Jul. 10, 1984; U.S. Pat. No. 4,841,246, which issued to Juds and Beihoff on Jun. 20, 1989; U.S. Pat. No. 4,581,993, which issued to Schoneberger on Apr. 15, 1986; U.S. Pat. No. 4,360,889, which issued to Liedtke on Nov. 23, 1982; U.S. Pat. No. 5,222,457, which issued to Friedrich on Jun. 6, 1993; U.S. Pat. No. 4,899,643, which issued to Hvilsted and Pedersen on Feb. 13, 1990; U.S. Pat. No. 5,396,139, which issued to Surmely and Taghezout on Mar. 7, 1995; U.S. Pat. No. 5,419,195, which issued to Quinn on May 30, 1995; U.S. Pat. No. 5,424,632, which issued to Montagu on Jun. 13, 1995; U.S. Pat. No. 5,433,118, which issued to Castillo on Jul. 18, 1995; U.S. Pat. No. 5,442,329, which issued to Ghosh and DaSilva on Aug. 15, 1995; and U.S. Pat. No. 5,444,368, which issued to Horber on Aug. 22, 1995.

Examples of worm gears or worm gear transmissions, components of which may be incorporated in embodiments of the present invention may be found in the following U.S. Pat. No. 5,816,103, issued Oct. 6, 1998 to Huang; U.S. Pat. No. 5,515,626, issued May 14, 1996 to Holscher; U.S. Pat. No. 5,503,045, issued Apr. 2, 1996 to Riester; U.S. Pat. No. 5,454,766, issued Oct. 3, 1995 to Mills; U.S. Pat. No. 5,003,836, issued Apr. 2, 1991 to Mitsugu et al.; U.S. Pat. No. 4,784,017, issued Nov. 15, 1988 to Johnsoy, and U.S. Pat. No. 4,040,307, issued Aug. 9, 1977 to Koster.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. 198 14 625.6, filed on Apr. 1, 1998, having inventor Herbert Bernhard, and DE-OS 198 14 625.6 and DE-PS 198 14 625.6, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A bottle handling arrangement having a rinser, a filling machine, a crown corker, and a screw-top capping machine, said bottle handling arrangement comprising:

a first star wheel arrangement comprising a star wheel;

said first star wheel arrangement being configured and disposed to receive bottles;

said star wheel of said first star wheel arrangement being configured to rotate to move said bottles;

a rinser;

said rinser being configured and disposed to receive said bottles directly from said first star wheel arrangement;

said rinser being configured to rotate to move said bottles;

a second star wheel arrangement comprising a star wheel;

said second star wheel arrangement being configured and disposed to receive said bottles directly from said rinser;

said star wheel of said second star wheel arrangement being configured to rotate to move said bottles;

a filling machine;

said filling machine being configured and disposed to receive said bottles directly from said second star wheel arrangement;

said filling machine being configured to rotate to move said bottles;

a third star wheel arrangement comprising a star wheel;

said third star wheel arrangement being configured and disposed to receive said bottles directly from said filling machine;

a crown corker;

a screw-top capping machine;

said star wheel of said third star wheel arrangement being configured to rotate to move said bottles from said filling machine to one of said crown corker and said screw-top capping machine;

each of said crown corker and said screw-top capping machine being configured and disposed to receive said bottles directly from said third star wheel arrangement;

each of said crown corker and said screw-top capping machine being configured to rotate to move said bottles;

a fourth star wheel arrangement comprising a star wheel;

said fourth star wheel arrangement being configured and disposed to receive said bottles directly from either of said crown corker and said screw-top capping machine;

a conveyor apparatus;

said star wheel of said fourth star wheel arrangement being configured to rotate to move said bottles from either of said crown corker and said screw-top capping machine to said conveyor apparatus;

said star wheels of said star wheel arrangements, said rinser, said filling machine, said crown corker, and said screw-top capping machine being disposed to define a bottle transport plane along which bottles are moved;

each of said first star wheel arrangement, said second star wheel arrangement, said filling machine, said third star wheel arrangement, said crown corker, said screw-top capping machine, and said fourth star wheel arrangement comprising an axis of rotation;

said axes of rotation of said first star wheel arrangement, said second star wheel arrangement, and said filling machine each being disposed in a first alignment to lie on a first straight line lying in said bottle transport plane;

said axes of rotation of said filling machine, said third star wheel arrangement, and said crown corker each being disposed in a second alignment to lie on a second straight line lying in said bottle transport plane;

said axes of rotation of said screw-top capping machine and said fourth star wheel arrangement each being disposed in a third alignment to lie on a third straight line lying in said bottle transport plane; and said third straight line lying in said bottle transport plane being parallel to said second straight line of the second alignment defined by the axes of rotation of said filling machine, said third star wheel arrangement, and said crown corker.

2. The bottle handling arrangement according to claim 1, wherein:

said axes of rotation of said third star wheel arrangement, said crown corker, said screw-top capping machine, and said fourth star wheel arrangement each being disposed in a fourth alignment to form the corners of at least one of: a square, a rectangle, and a parallelogram;

said second straight line runs at an angle of approximately 45 degrees to said first straight line;

each of said star wheel arrangements, said rinser, said filling machine, said crown corker, and said screw-top capping machine comprises a bottle transport arrangement configured to transport said bottles; and each of said bottle transport arrangements comprises:

a drive device configured and disposed to provide a driving force to rotate its corresponding bottle transport arrangement;

each of said drive devices is located underneath and at a substantial distance away from said bottle transport plane;

a protective hood configured and disposed to cover and protect its corresponding drive device;

a drive shaft;

said drive shaft is connected to its corresponding drive device and its corresponding bottle transport arrangement to transmit said driving force from said corresponding drive device to said corresponding bottle transport arrangement; and each of said drive shafts are enclosed by a tower-like housing, which housing is connected in a sealed manner to said protective hood and extends from said protective hood to said bottle transport plane.

3. The bottle handling arrangement according to claim 2, wherein:

said protective hood is configured and disposed to provide support for said tower-like housing;

each of said protective hoods has a circumference;

each of said drive devices has a circumference;

said circumference of each of said protective hoods is substantially similar to the circumference of its corresponding drive device;

each of said tower-like housings has a tapered, conical portion substantially in the shape of a truncated cone or pyramid;

each of said protective hoods is substantially cone-shaped and comprises a top portion and a base portion disposed opposite said top portion, which base portion is substantially wider than said top portion;

said top portion is disposed adjacent said tower-like housing;

each of said protective hoods comprises a side surface, which side surface extends from said base portion to said top portion;

each of said side surfaces is one of: a curved surface and a flat surface;

each of said protective hoods is in the form of one of: a single-level casting and a welded body;

each of said tower-like housings of said star wheel arrangements comprises a support structure disposed at said bottle transport plane to support its corresponding star wheel; and each of said star wheels comprises support arms which extend outward from the support structure in the shape of a star.

4. A bottle handling arrangement having a rinser, a filling machine, a first capping machine, and a second capping machine, said bottle handling arrangement comprising:

a first star wheel;

said first star wheel being configured and disposed to receive bottles;

said first star wheel being configured to rotate to move said bottles;

a rinser;

said rinser being configured and disposed to receive said bottles from said first star wheel;

said rinser being configured to rotate to move said bottles;

a second star wheel;

said second star wheel being configured and disposed to receive said bottles from said rinser;

said second star wheel being configured to rotate to move said bottles;

a filling machine;

said filling machine being configured and disposed to receive said bottles from said second star wheel;

said filling machine being configured to rotate to move said bottles;

a third star wheel;

said third star wheel being configured and disposed to receive said bottles from said filling machine;

a first capping machine;

a second capping machine;

said third star wheel being configured to rotate to move said bottles from said filling machine to one of said first capping machine and said second capping machine;

each of said first capping machine and said second capping machine being configured and disposed to receive said bottles from said third star wheel;

each of said first capping machine and said second capping machine being configured to rotate to move said bottles;

a fourth star wheel;

said fourth star wheel being configured and disposed to receive said bottles from either of said first capping machine and said second capping machine;

a conveyor apparatus;

said fourth star wheel being configured to rotate to move said bottles from either of said first capping machine and said second capping machine to said conveyor apparatus;

said star wheels, said rinser, said filling machine, said first capping machine, and said second capping machine being disposed to define a bottle transport plane along which bottles are moved;

each of said first star wheel, said second star wheel, said filling machine, said third star wheel, said first capping machine, said second capping machine, and said fourth star wheel comprising an axis of rotation;

said axes of rotation of said first star wheel, said second star wheel, and said filling machine each being disposed to lie on a first straight line lying in the bottle transport plane;

said axes of rotation of said filling machine, said third star wheel, and said first capping machine each being disposed to lie on a second straight line lying in the bottle transport plane;

said axes of rotation of said second capping machine and said fourth star wheel being disposed to lie on a third straight line lying in the bottle transport plane; and said third straight line lying in said bottle transport plane being disposed substantially parallel to the second straight line lying in the bottle transport plane.

5. The bottle handling arrangement according to claim 4, wherein:

said first capping machine comprises one of: a crown corker and a screw-top capping machine; and said second capping machine comprises the other one of: said crown corker and said screw-top capping machine.

6. A bottle handling arrangement having a rinser, a filling machine, a first capping machine, and a second capping machine, said bottle handling arrangement comprising:

a first star wheel arrangement comprising a star wheel;

said first star wheel arrangement being configured and disposed to receive bottles;

said star wheel of said first star wheel arrangement being configured to rotate to move said bottles;

a rinser;

said rinser being configured and disposed to receive said bottles from said first star wheel arrangement;

said rinser being configured to rotate to move said bottles;

a second star wheel arrangement comprising a star wheel;

said second star wheel arrangement being configured and disposed to receive said bottles from said rinser;

said star wheel of said second star wheel arrangement being configured to rotate to move said bottles;

a filling machine;

said filling machine being configured and disposed to receive said bottles from said second star wheel arrangement;

said filling machine being configured to rotate to move said bottles;

a third star wheel arrangement comprising a star wheel;

said third star wheel arrangement being configured and disposed to receive said bottles from said filling machine;

a first capping machine;

a second capping machine;

said star wheel of said third star wheel arrangement being configured to rotate to move said bottles from said filling machine to one of said first capping machine and said second capping machine;

each of said first capping machine and said second capping machine being configured and disposed to receive said bottles from said third star wheel arrangement;

each of said first capping machine and said second capping machine being configured to rotate to move said bottles;

a fourth star wheel arrangement comprising a star wheel;

said fourth star wheel arrangement being configured and disposed to receive said bottles from either of said first capping machine and said second capping machine;

a conveyor apparatus;

said star wheel of said fourth star wheel arrangement being configured to rotate to move said bottles from either of said first capping machine and said second capping machine to said conveyor apparatus;

said star wheels of said star wheel arrangements, said rinser, said filling machine, said first capping machine, and said second capping machine being disposed to define a bottle transport plane along which bottles are moved;

each of said first star wheel arrangement, said second star wheel arrangement, said filling machine, said third star wheel arrangement, said first capping machine, said second capping machine, and said fourth star wheel arrangement comprising an axis of rotation;

said axes of rotation of said first star wheel arrangement, said second star wheel arrangement, and said filling machine each being aligned in a first alignment lying in said bottle transport plane;

said axes of rotation of said filling machine, said third star wheel arrangement, and said first capping machine each being aligned in a second alignment lying in said bottle transport plane;

said axes of rotation of said second capping machine and said fourth star wheel arrangement being aligned in a third alignment lying in said bottle transport plane; and the third alignment being aligned substantially parallel to the second alignment.

7. The bottle handling arrangement according to claim 6, wherein:

said first capping machine comprises one of: a crown corker and a screw-top capping machine; and said second capping machine comprises the other one of: said crown corker and said screw-top capping machine.

8. The bottle handling arrangement according to claim 7, wherein said axes of rotation of said third star wheel arrangement, said first capping machine, said second capping machine, and said fourth star wheel arrangement each being disposed in a fourth alignment to form the corners of at least one of: a square, a rectangle, and a parallelogram.

9. The bottle handling arrangement according to claim 8, wherein:

each of said star wheel arrangements, said rinser, said filling machine, said first capping machine, and said second capping machine comprises a bottle transport arrangement configured to transport said bottles; and each of said bottle transport arrangements comprises:

a drive device configured and disposed to provide a driving force to rotate its corresponding bottle transport arrangement;

each of said drive devices is located underneath and at a substantial distance away from said bottle transport plane;

a protective hood configured and disposed to cover and protect its corresponding drive device;

a drive shaft;

said drive shaft is connected to its corresponding drive device and its corresponding bottle transport arrangement to transmit said driving force from said corresponding drive device to said corresponding bottle transport arrangement; and each of said drive shafts are enclosed by a tower-like housing, which housing is connected in a sealed manner to said protective hood and extends from said protective hood to said bottle transport plane.

10. The bottle handling arrangement according to claim 9, wherein said second straight line runs at an angle of approximately 45 degrees to said first straight line.

11. The bottle handling arrangement according to claim 10, wherein:

said protective hood is configured and disposed to provide support for said tower-like housing;

each of said protective hoods has a circumference;

each of said drive devices has a circumference; and said circumference of each of said protective hoods is substantially similar to the circumference of its corresponding drive device.

12. The bottle handling arrangement according to claim 11, wherein:

each of said tower-like housings has a tapered, conical portion substantially in the shape of a truncated cone or pyramid;

each of said protective hoods is substantially cone-shaped and comprises a top portion and a base portion disposed opposite said top portion, which base portion is substantially wider than said top portion; and said top portion is disposed adjacent said tower-like housing.

13. The bottle handling arrangement according to claim 12, wherein:

each of said protective hoods comprises a side surface, which side surface extends from said base portion to said top portion; and each of said side surfaces is one of: a curved surface and a flat surface.

14. The bottle handling arrangement according to claim 13, wherein:

each of said protective hoods is in the form of one of: a single-level casting and a welded body;

each of said tower-like housings of said star wheel arrangements comprises a support structure disposed at said bottle transport plane to support its corresponding star wheel; and each of said star wheels comprises support arms which extend outward from the support structure in the shape of a star.

* * * * *